US009695556B2

(12) United States Patent
Phillips

(10) Patent No.: US 9,695,556 B2
(45) Date of Patent: Jul. 4, 2017

(54) SEALING PANEL DEVICE

(71) Applicant: Thomas Raymond Phillips, Rockledge, FL (US)

(72) Inventor: Thomas Raymond Phillips, Rockledge, FL (US)

( * ) Notice: Subject to any disclaimer, the term of this patent is extended or adjusted under 35 U.S.C. 154(b) by 84 days.

(21) Appl. No.: 14/944,651

(22) Filed: Nov. 18, 2015

(65) Prior Publication Data

US 2016/0145813 A1 May 26, 2016

Related U.S. Application Data

(60) Provisional application No. 62/082,201, filed on Nov. 20, 2014.

(51) Int. Cl.

| | |
|---|---|
| ***E04B 5/00*** | (2006.01) |
| ***E01C 9/08*** | (2006.01) |
| ***E01C 5/00*** | (2006.01) |
| ***E04B 5/02*** | (2006.01) |

(52) U.S. Cl.

CPC ..... *E01C 9/08* (2013.01); *E01C 5/005* (2013.01); *E04B 5/02* (2013.01); *E04B 5/023* (2013.01); *E04B 5/026* (2013.01); *E01C 2201/12* (2013.01)

(58) Field of Classification Search

CPC ..... E01C 5/005; E01C 9/08; E01C 2201/12; E04B 5/02; E04B 5/023; E04B 5/026

USPC ..... 14/2.6, 27

See application file for complete search history.

(56) References Cited

U.S. PATENT DOCUMENTS

| | | | | |
|---|---|---|---|---|
| 3,691,974 | A * | 9/1972 | Seiford, Sr. | B63B 35/38 114/266 |
| 3,983,930 | A * | 10/1976 | Franz | G05D 23/1925 165/204 |
| 4,561,376 | A * | 12/1985 | Fitzgerald-Smith | B63B 7/02 114/267 |
| 5,383,672 | A | 1/1995 | Cornelius | |
| 6,470,820 | B1 * | 10/2002 | Wilkins | B63B 3/08 114/266 |
| 7,314,017 | B2 | 1/2008 | Moore | |

FOREIGN PATENT DOCUMENTS

| | | | | |
|---|---|---|---|---|
| GB | WO 9321390 | * | 4/1993 | E01D 15/12 |
| GB | 2490508 | * | 5/2011 | B63B 35/38 |

* cited by examiner

*Primary Examiner* — Raymond W Addie
(74) *Attorney, Agent, or Firm* — PatentFile, LLC; Bradley C. Fach; Steven R. Kick

(57) ABSTRACT

A sealing panel device for use with a guillotine well having a length, width, and depth is provided. In some embodiments the device may comprise an elongate panel having a length and width that is greater than the length and width of the guillotine well. A first arm and a second arm may be coupled to the elongate panel. The first arm may comprise a width greater than the width of the guillotine well and a depth greater than the depth of the guillotine well. The second arm may comprise a width greater than the width of the guillotine well and a depth greater than the depth of the guillotine well. A sealing gasket may be coupled to the elongate panel, first arm, and second arm which may extend around the guillotine well when the device is positioned over the guillotine well of a Modular Causeway Systems section.

20 Claims, 12 Drawing Sheets

SEALING PANEL DEVICE

CROSS REFERENCE TO RELATED APPLICATIONS

This application claims priority to and the benefit of the filing date of U.S. Provisional Application No. 62/082,201, filed on Nov. 20, 2014, entitled "NOVEL SEALING DEVICES AND APPARATUSES FOR CONNECTOR ASSEMBLIES AND THE LIKE", which is hereby incorporated by reference in its entirety.

FIELD OF THE INVENTION

This patent specification relates to the field of sealing devices and apparatuses for sealing connector assembly areas and related components. More specifically, this patent specification relates to a sealing device for sealing guillotine well assemblies typically found on Modular Causeway Systems and the like.

BACKGROUND

Approximately 20 years ago the Army (US) budgeted about $100 m on a project and supply system. This system was designed to facilitate the transport and deployment of support equipment with various ships, tugboats, and cranes. This support equipment is also known as Army Material and has been deemed an important contingency activity for the US military. As such, it is only to be used under certain and specific war scenarios or combat situations.

The support equipment includes a Modular Causeway System (MCS) in which a vehicle causeway can be transported, assembled, and rapidly deployed from transport vessels such as ships and boats. The MCS is assembled with a plurality of MCS sections or ISOPAK units which form a road, causeway, turning platform and several other configurations. Each MCS section comprises a plurality of guillotine well assemblies which function as rapid attachment points for cranes, transport equipment, and other MCS sections. Reliable attachment is dependent on the free movement of, among other components, a spring tensioned Connector Assembly Mechanism (CAM) which is located within the guillotine wells.

When not in use, the support equipment is kept in Prepositioned Condition/Storage (PREPO) where it is frequently exposed to the environment and other undesirable elements. While in this PREPO configuration, the CAB often becomes clogged with dirt, sand, corrosion, and even animal nests and debris and subsequently requires significant labor to maintain the ISOPAKS in duty ready condition in a short period of time. For many years CAM maintenance has been identified as a drain/concern in: parts, labor, maintenance, safety, and a hindrance on the ability to activate the MCS program in a very short time window.

Therefore a need exists for a novel sealing structure capable of preventing the accumulation of animal nesting, dirt, sand, and debris within the CAMs. A further need exists for a sealing structure that is capable of shielding the CAM from rain and water accumulation within the guillotine wells. There is also a need for the sealing structure to be able to vent and prevent the accumulation of condensation within the guillotine wells. Finally, there is a need for the sealing structure to be able to accommodate a range of guillotine well sizes frequently encountered due to varied production processes and techniques.

BRIEF SUMMARY OF THE INVENTION

A sealing panel device for use with Modular Causeway Systems sections which typically includes a Connector Assembly Mechanism within a guillotine well with the guillotine well having a length, width, and depth is provided. The device may be positioned over the guillotine well to seal or protect the guillotine well from the environment. In some embodiments the sealing panel device may comprise an elongate panel having a top portion and a bottom portion and having a length and width that is greater than the length and width of the guillotine well. A first arm may be coupled to the top portion of the elongate panel and a second arm may be coupled to the bottom portion of the elongate panel. The first arm may comprise a width greater than the width of the guillotine well and a depth greater than the depth of the guillotine well. The second arm may comprise a width greater than the width of the guillotine well and a depth greater than the depth of the guillotine well. A sealing gasket may be coupled to the elongate panel, first arm, and second arm. The sealing gasket may contact the Modular Causeway Systems section around the guillotine well when the elongate panel device is positioned over the guillotine well of the Modular Causeway Systems section.

In further embodiments, the sealing panel device may comprise one or more magnets positioned to engage with the Modular Causeway Systems section when the device is positioned over the guillotine well of the Modular Causeway Systems section. A magnet may be positioned engage with the Modular Causeway System section by coupling the magnet to the first arm, to the second arm, to the elongate panel, and/or to anywhere else on the sealing panel device.

In still further embodiments, the sealing panel device may comprise a sealing insert coupled to the elongate panel, to the first arm, and/or to the second arm. The sealing insert may contact the Modular Causeway Systems section proximate to the guillotine well when the device is positioned over the guillotine well of the Modular Causeway Systems section.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
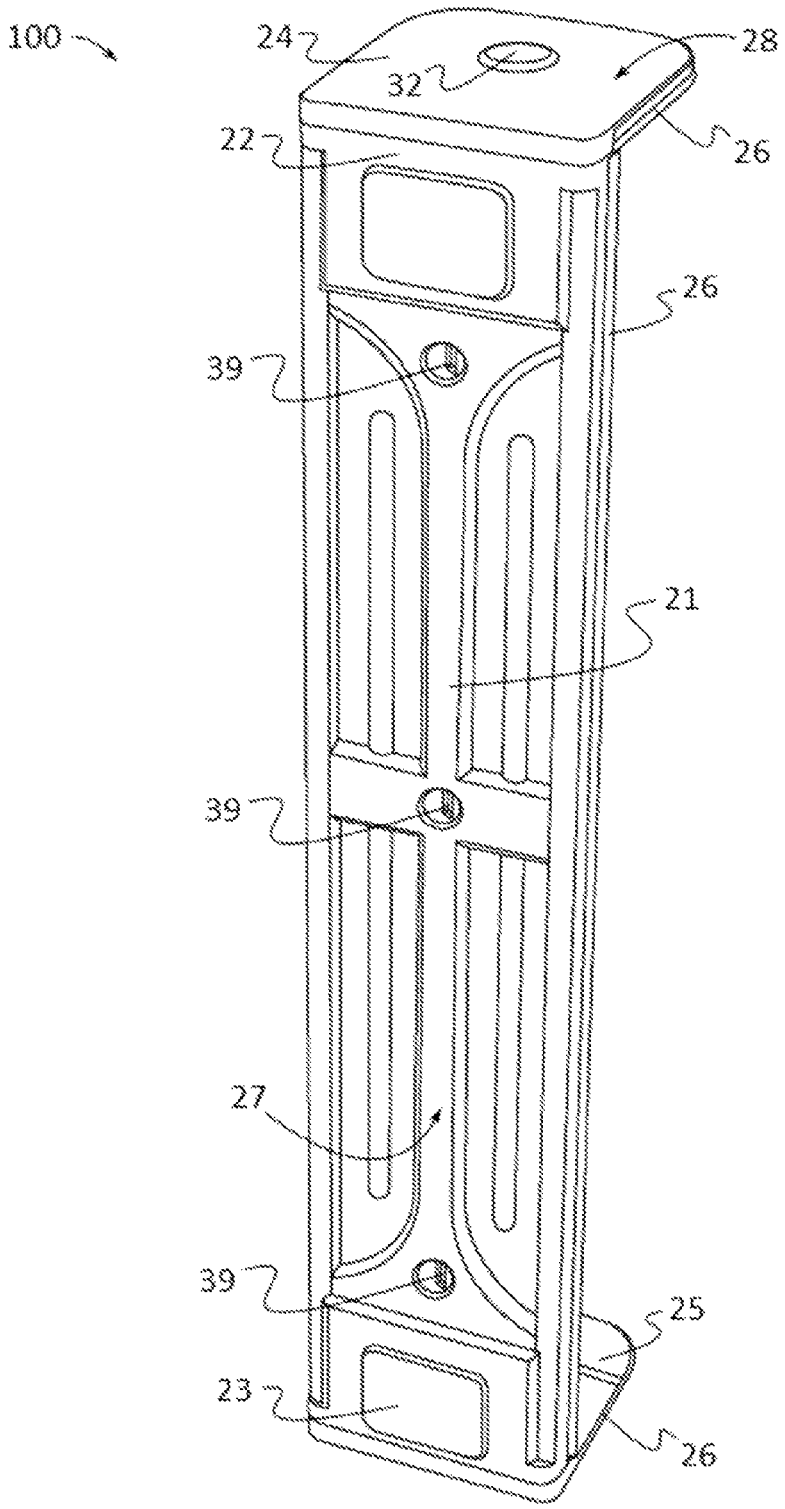
FIG. 1 depicts a front top perspective view of an example of a sealing panel device according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

A new sealing panel device for use with Modular Causeway Systems sections is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

The present invention will now be described by example and through referencing the appended figures representing preferred and alternative embodiments. FIGS. 1 - 4 illustrate an example of a sealing panel device ("the device") 100 according to various embodiments. The device 100 may be used with a Modular Causeway Systems (MCS) section 300 of the type used by the United States Army. A MCS section 300 includes a Connector Assembly Mechanism 301 (FIGS. 7, 12, 15) within a guillotine well 302 (FIGS. 7, 12-15) that is used to facilitate the interconnection of MCS sections 300, such as example sections 300A (FIGS. 13) and 300B (FIG. 14), of a modular causeway system. Such modular causeway systems provide a means to move cargo from ship to shore across unimproved beaches in areas of the world where fixed port facilities are unavailable, denied or otherwise unacceptable. In such modular causeway systems, a plurality of MCS sections 300, such as example sections 300A and 300B, can be joined together in different configurations to form buoyant vessels suitable for use in many different applications. To simplify the drawings and the description of the invention, two example sections 300A and 300B are illustrated. However, it should be understood that MCS sections 300 generally are formed from a plurality of components. The MCS sections are composed of modular, International Standards Organization (ISO) compatible modules. By way of example, systems can be configured from basic modules in various configurations, including, but not limited to, a roll-on/roll-off discharge facility (RRDF); a causeway ferry (CF); a floating causeway (FC); and a warping tug (WT).

The MCS is termed modular because it is made up of a plurality of MCS sections 300 each of which can be formed from a plurality separate modules. A plurality of modules are interconnected to form MCS sections 300 and a plurality of MCS sections 300 can be interconnected to form other systems, including those listed above.

In some embodiments, the device 100 may comprise an elongate panel 21 having a top portion 22 and a bottom portion 23. A first arm 24 may be coupled to the top portion 22 and a second arm 25 may be coupled to the bottom portion 23 of the elongate panel 21. A sealing gasket 26 may be coupled to the elongate panel 21, first arm 24, and second arm 25. The sealing gasket 26 may contact the Modular Causeway Systems section 300 (FIGS. 13 and 14) around the guillotine well 302 when the device 100 is positioned over the guillotine well 302 of the MCS section 300.

The first arm 24 may be coupled to the top portion 22 of the elongate panel 21 to extend away from the front surface 17 of the elongate panel 21 at generally a right angle. In some embodiments, the first arm 24 may comprise a front surface 28 which may be coupled to the front surface 27 of the elongate panel 21. The second arm 25 may be coupled to the bottom portion 23 of the elongate panel 21 to extend away from the front surface 17 of the elongate panel 21 at generally a right angle. In some embodiments, the second arm 24 may comprise a front surface 29 which may be coupled to the front surface 27 of the elongate panel 21. Preferably the front surfaces 27, 28, 29, may be formed by a weather resistant material such as ABS plastic with UV protection or any other suitable rigid material such as other types of plastics, resins, metals and metal alloys. In still further embodiments, the arms 24, 25, may be made of a flexible or resilient material and angled slightly towards each other allowing the arms 24, 25, to grip portions of the MCS section 300 (FIGS. 7, 8, 12-15) around the guillotine well 302 (FIGS. 7, 12-15) when the device 100 is positioned over the guillotine well 302 of the MCS section 300.

Generally, the device 100 may be configured to extend around and cover a guillotine well 302 (FIGS. 7, 12-15) which typically comprises dimensions L1, W1, D1, and which is found on a MCS section 300 (FIGS. 7, 8, 12-15). In some embodiments, the elongate panel 21 may comprise a length (L2) (FIG. 12) which is greater than the length (L1) (FIG. 12) of the guillotine well 302 and a width (W4) (FIG. 8) which is greater than the width (W1) (FIG. 7) of the guillotine well 302. The first arm 24 may comprise a depth (D2) (FIG. 12) which is greater than the depth (D1) (FIG. 12) of the guillotine well 302 and a width (W2) (FIG. 3) which is greater than the width (W1) (FIG. 7) of the guillotine well 302. The second arm 25 may comprise a depth (D3) (FIG. 12) which is greater than the depth (D1) (FIG. 12) of the guillotine well 302 and a width (W3) (FIG. 3) which is greater than the width (W1) (FIG. 7) of the guillotine well 302. With dimensions L2, W4, W2, D2, W3, D3, of the device 100 greater than the dimensions L1, W1, D1, of the guillotine well 302, the elongate panel 21, first arm 24, and second arm 25, may completely cover and extend around the guillotine well 302 when the device 100 is positioned over a guillotine well 302 of the Modular Causeway Systems section 300.

In some embodiments, the device 100 may comprise one or more magnets 32 which may be attracted to so as to engage with the ferrous metals which are typically used to form MCS sections 300 (FIGS. 7, 8, 12-15). A magnet 32 may be positioned to engage with the MCS section 300 when the device 100 is positioned over the guillotine well 302 (FIGS. 7, 12-15) of the MCS section 300. In further embodiments, a magnet 32 may be positioned to engage with the top of the MCS section 300 by coupling the magnet 32 to the first arm 24. In still further embodiments, a magnet 32 may be positioned to engage with the bottom of the MCS section 300 by coupling the magnet 32 to the second arm 25. In even further embodiments, a magnet 32 may be positioned to engage with the side of the MCS section 300 by coupling the magnet 32 to the elongate panel 21. By positioning one or more magnets on the device 100, such as proximate to the sealing gasket 26 and/or to a sealing insert 31, the magnets 32 may be positioned to engage with the MCS section 300.

In preferred embodiments, the elongated panel 21 may comprise two magnets 32, with one magnet 32 positioned on the upper first arm 24 and one magnet 32 positioned on the lower second arm 25 of the elongated panel 21. In some embodiments, the magnets 32 may be coupled to the arms 24, 25, in an adjustable manner so as to provide plus or minus approximately 0.5 inches of movement in the x, y, and z planes. A magnet 32 may be made from ferrite, manganese-zince ferrite, nickel-zinc ferrite, strontium ferrite, cobalt ferrite, barium ferrite, magnetic alloys such as alnico, comol, hypernom, iron-silicon magnet alloys, magnet steel, chromindur, silmanal, platinax, bismanol, cobalt-platinum alloys, chromium-manganese antimonide, ultra-mag, vectolite, magnadur, lodex, awaruite, wairauite, rare earth magnets such as samarium-cobalt, cesium-cobalt, neodymium-iron-boron, metallic oxides such as magnetite, ulvospinel, hematite, ilmenite, maghemite, jacobsite, metallic sulfides such as pyrrhotite, greigite, troilite, metallic oxyhydroxides such as goethite, lepidocrocite, feroxyhyte, metals such as iron, nickel, cobalt, or any other suitable magnetic material that is capable of magnetically adhering or engaging to another magnetic material.

As shown in FIGS. 1-4 and 12, a sealing gasket 26 may be coupled to the elongate panel 21, first arm 24, and second arm 25. The sealing gasket 26 may extend away from the elongate panel 21, first arm 24, and second arm 25 to contact the MCS section 300 (FIGS. 7, 8, 12-15) around the guillotine well 302 (FIGS. 7, 12-15) when the sealing panel device 100 is positioned over the guillotine well 302 of the MCS section 300. In some embodiments, the sealing gasket 26 may be made from a single length of material which may extend around the perimeter of the elongate panel 21, first arm 24, and second arm 25 to form a continuous barrier to the environment when the sealing gasket 26 contacts the MCS section 300 around the guillotine well 302. In other embodiments, the sealing gasket 26 may be formed of two or more sections which may be positioned preferably in an overlapping manner and which may extend around the perimeter of the elongate panel 21, first arm 24, and second arm 25 to form a continuous barrier to the environment when the sealing gasket 26 contacts the MCS section 300 around the guillotine well 302. In further embodiments, a sealing gasket 26 may extend to cover all or portions of an elongate panel 21, first arm 24, and/or second arm 25 opposite their respective front surfaces 27, 28, 29. A sealing gasket 26 may be made of ethylene propylene diene monomer (EPDM) rubber, a thermoplastic elastomer (TPE) mix of plastic and rubber, a thermoplastic olefin (TPO) polymer/filler blend, silicone, or any other suitable material such as may be used for weather stripping.

Optionally, the device may comprise one or more sealing inserts 31 which may be coupled to all or portions of the elongate panel 21, first arm 24, and/or second arm 25. In some embodiments, a sealing insert 31 may be made from a single unit of material which may extend across all or portions of the elongate panel 21, first arm 24, and second arm 25 proximate to the sealing gasket to form a continuous secondary barrier to the environment by contacting portions of the MCS section 300 around the guillotine well 302 and proximate to the sealing gasket 26. In other embodiments, two or more sealing inserts 31 may be coupled to and extend across all or portions of the elongate panel 21, first arm 24, and second arm 25 proximate to the sealing gasket 26 to form a continuous secondary barrier to the environment by contacting portions of the MCS section 300 around the guillotine well 302 and proximate to the sealing gasket 26. For example, a sealing insert 31 may be coupled to the elongate panel 21, a sealing insert 31 may be coupled to the first arm 24, and/or a sealing insert 31 may be coupled to the second arm 25 to contact the MCS section 300 (FIGS. 7, 8, 12-15) proximate to the guillotine well 302 (FIGS. 7, 12-15) when the device 100 is positioned over the guillotine well 302 of the MCS section 300. A sealing insert 31 may be made of foam plastics, foam rubber, or any other foam or non-foam material including ethylene propylene diene monomer (EPDM) rubber, a thermoplastic elastomer (TPE) mix of plastic and rubber, a thermoplastic olefin (TPO) polymer/filler blend, silicone, or any other suitable material such as may be used for weather stripping.

Figure 2:
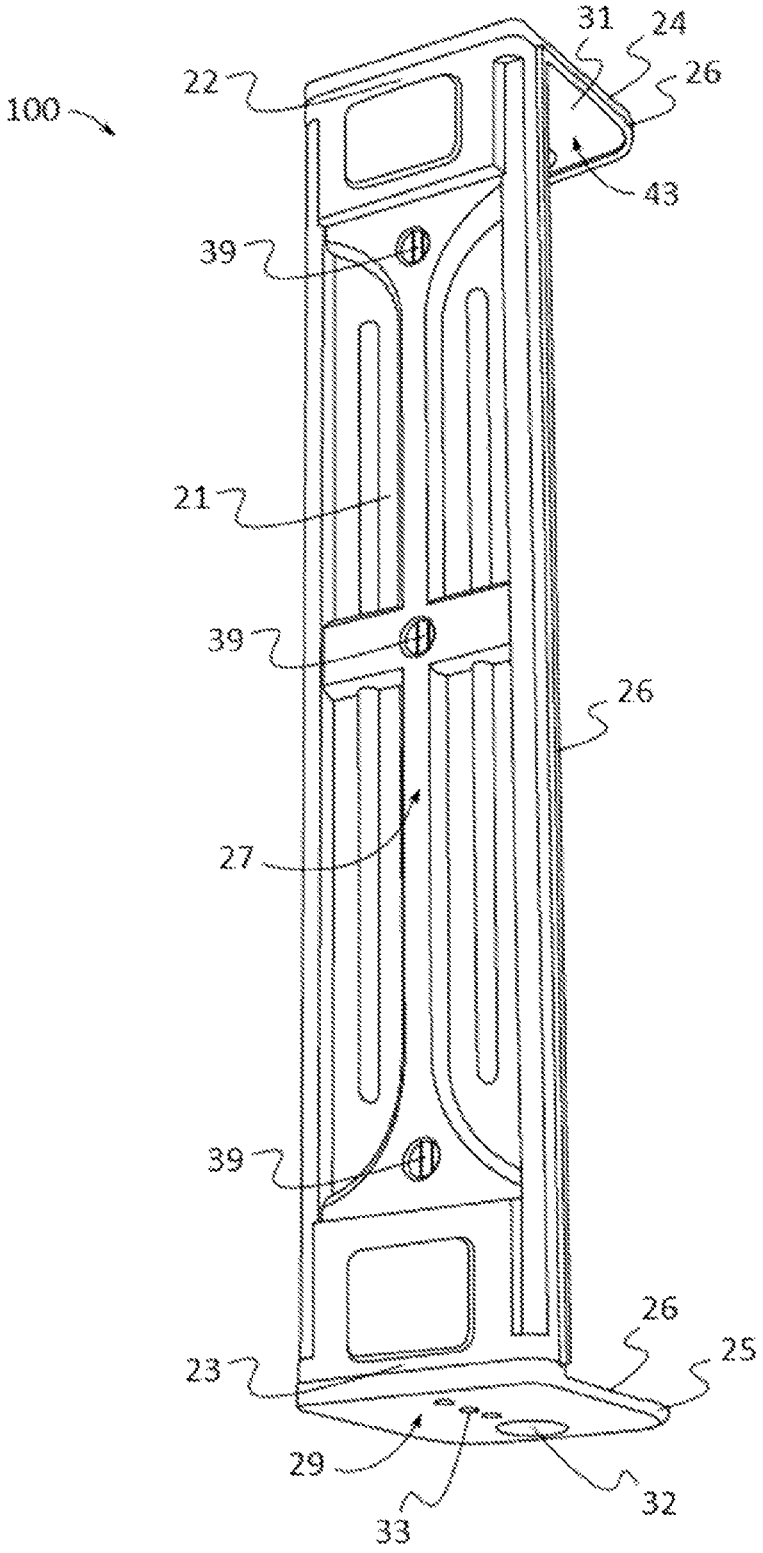
FIG. 2 illustrates a front bottom perspective view of an example of a sealing panel device according to various embodiments described herein.
Figure 3:
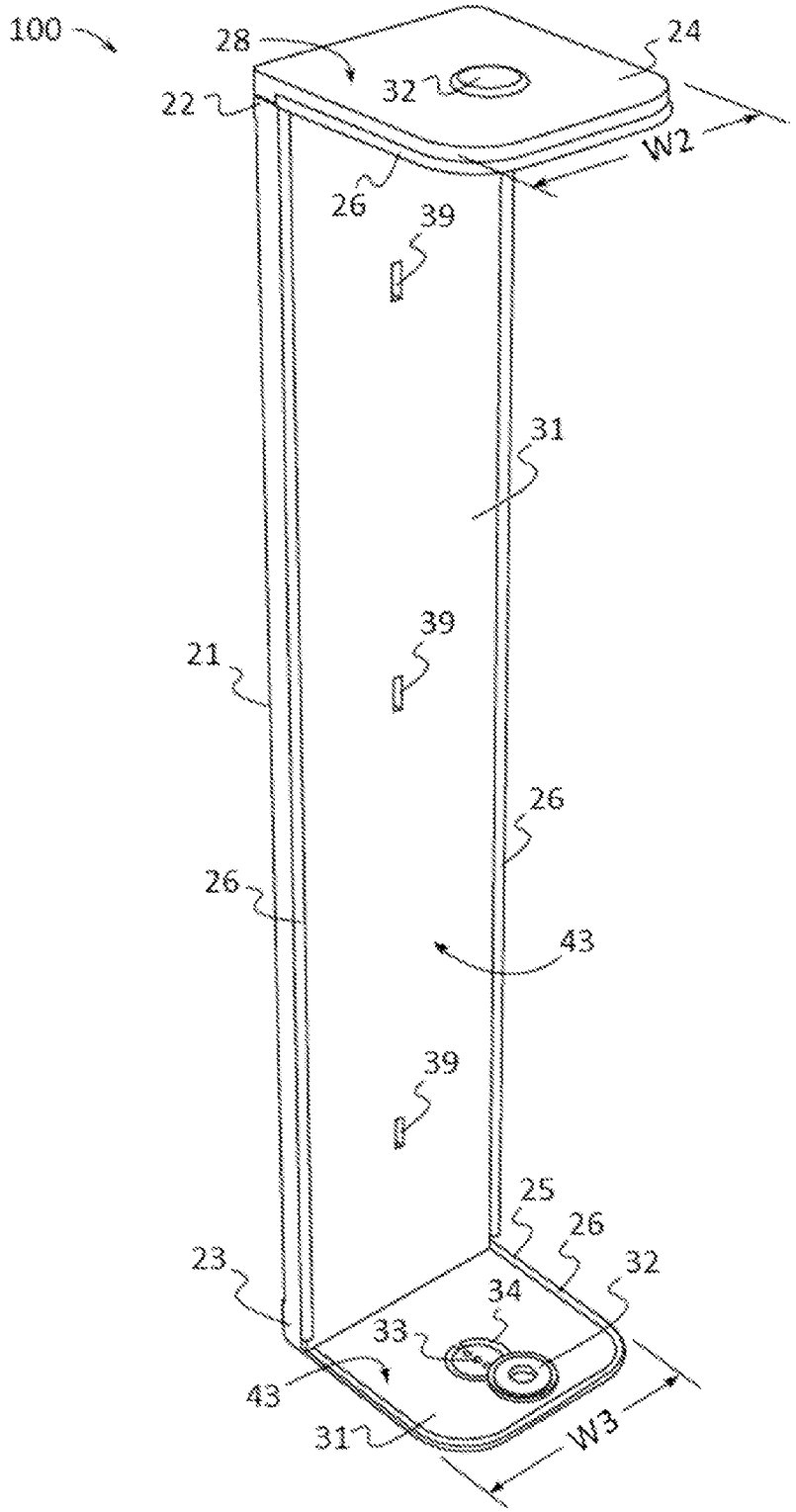
FIG. 3 shows a back top perspective view of an example of a sealing panel device according to various embodiments described herein.
Figure 4:
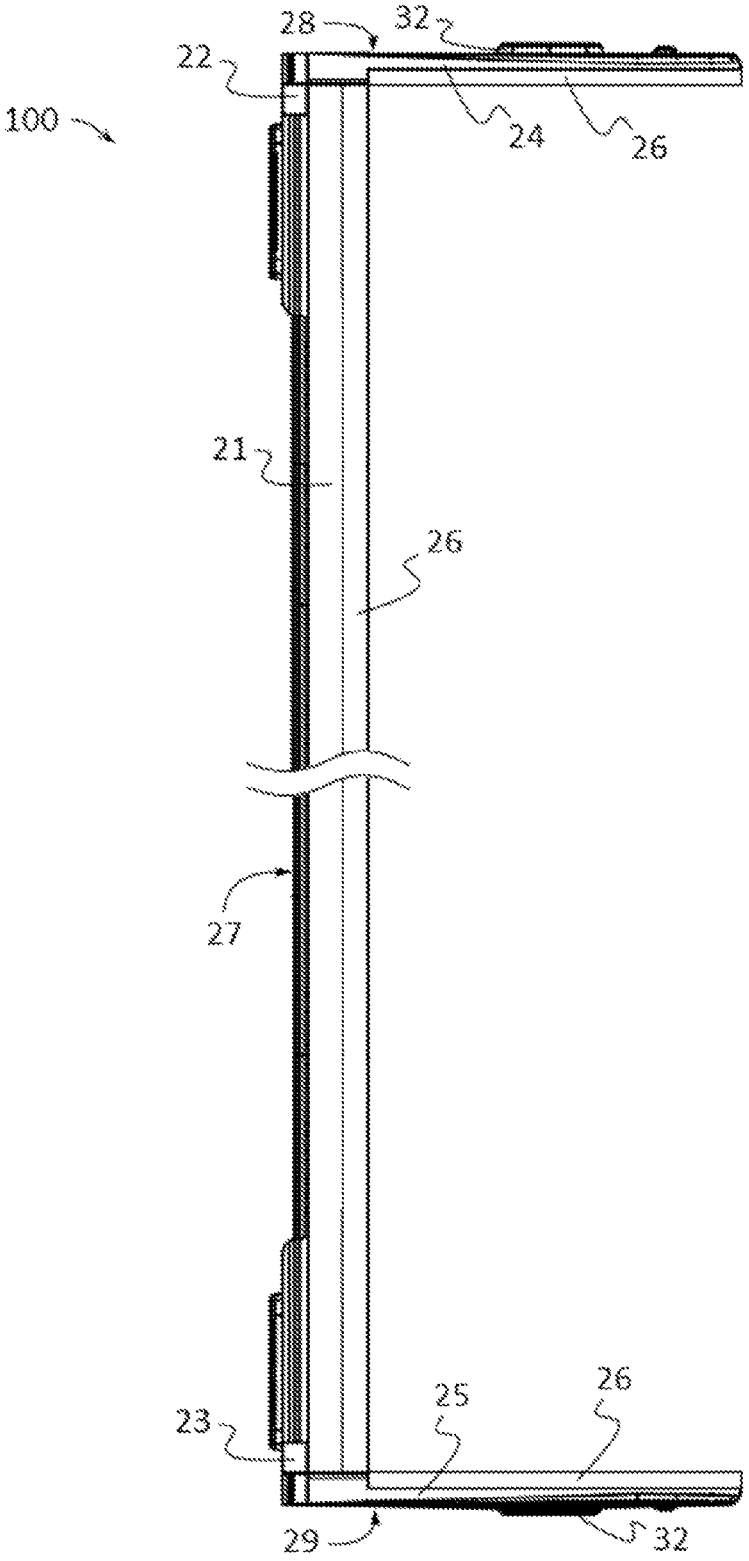
FIG. 4 depicts a side elevation view of an example of a sealing panel device according to various embodiments described herein.

Turning now to FIGS. 2 and 3, in some embodiments, the device 100 may comprise one or more vent apertures 33 in a second arm 25 which may extend through the second arm 25. A vent aperture 33 may be configured in various sizes and shapes to allow condensation, liquids, and vapor to pass through the second arm 25 to exit the guillotine well 302 (FIGS. 7, 12-15) when the device 100 is positioned over the guillotine well 302 (FIGS. 7, 12-15) of a MCS section 300 (FIGS. 7, 8, 12-15). In further embodiments, a vent aperture 33 may comprise a screen or mesh material to allow condensation, liquids, and vapor to pass through the second arm 25 while preventing the passage of insects and other pests. In still further embodiments, a vent aperture 33 may extend through the second arm 25 and through an optional sealing insert 31 which may be coupled to the second arm 25.

In some embodiments, a vent aperture 33 may be positioned within a vent depression 34. Generally, a vent depression 34 may comprise a recess, depression, sloping surface, or the like which is shaped to direct condensation and liquids on the second arm 25 towards a vent aperture 33 through the action of gravity. In further embodiments, a vent depression 34 may comprise a recess, depression, sloping surface, in the second arm 25 and/or in an optional sealing insert 31 which may be coupled to the second arm 25 which is shaped to direct condensation and liquids on the second arm 25 towards a vent aperture 33 through the action of gravity.

As shown in FIGS. 1-3 and 8, in some embodiments, the elongated panel 21 may comprise one or more panel apertures 39 which may extend through the elongated panel 21. In further embodiments, the elongated panel 21 may comprise one or more panel apertures 39 which may extend through the elongated panel 21 and through a sealing insert 31 which may be coupled to the elongated panel 21. Preferably, a panel aperture 39 may be shaped to receive a fastener 38 (FIGS. 6-8) to allow the fastener 38 to extend through the elongated panel 21 and to protrude above the front surface 27 of elongated panel 21. The panel apertures 39 may be disposed in the elongated panel 21 to be positioned to receive the fastener 38 of each mounting clip 35, 36, positioned to rest in or on a well aperture 303 and/or on a Connector Assembly Mechanism 301 of the guillotine well 302 (FIGS. 7, 12-15).

Figure 5:
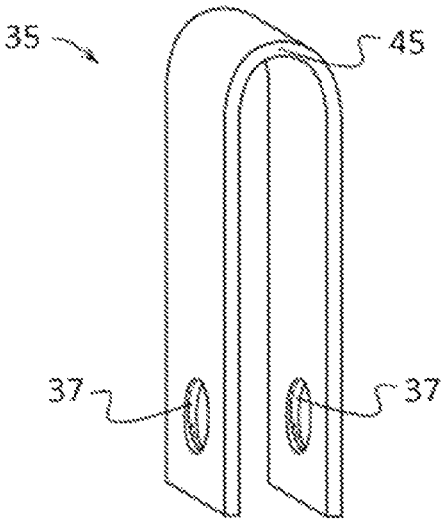
FIG. 5 illustrates a perspective view of an example of a mounting clip according to various embodiments described herein.
Figure 6:
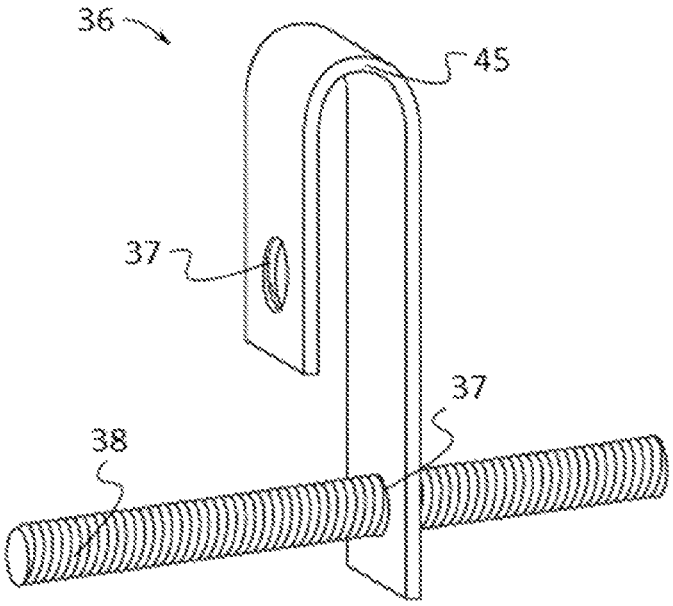
FIG. 6 shows a perspective view of an alternative example of a mounting clip according to various embodiments described herein.
Figure 7:
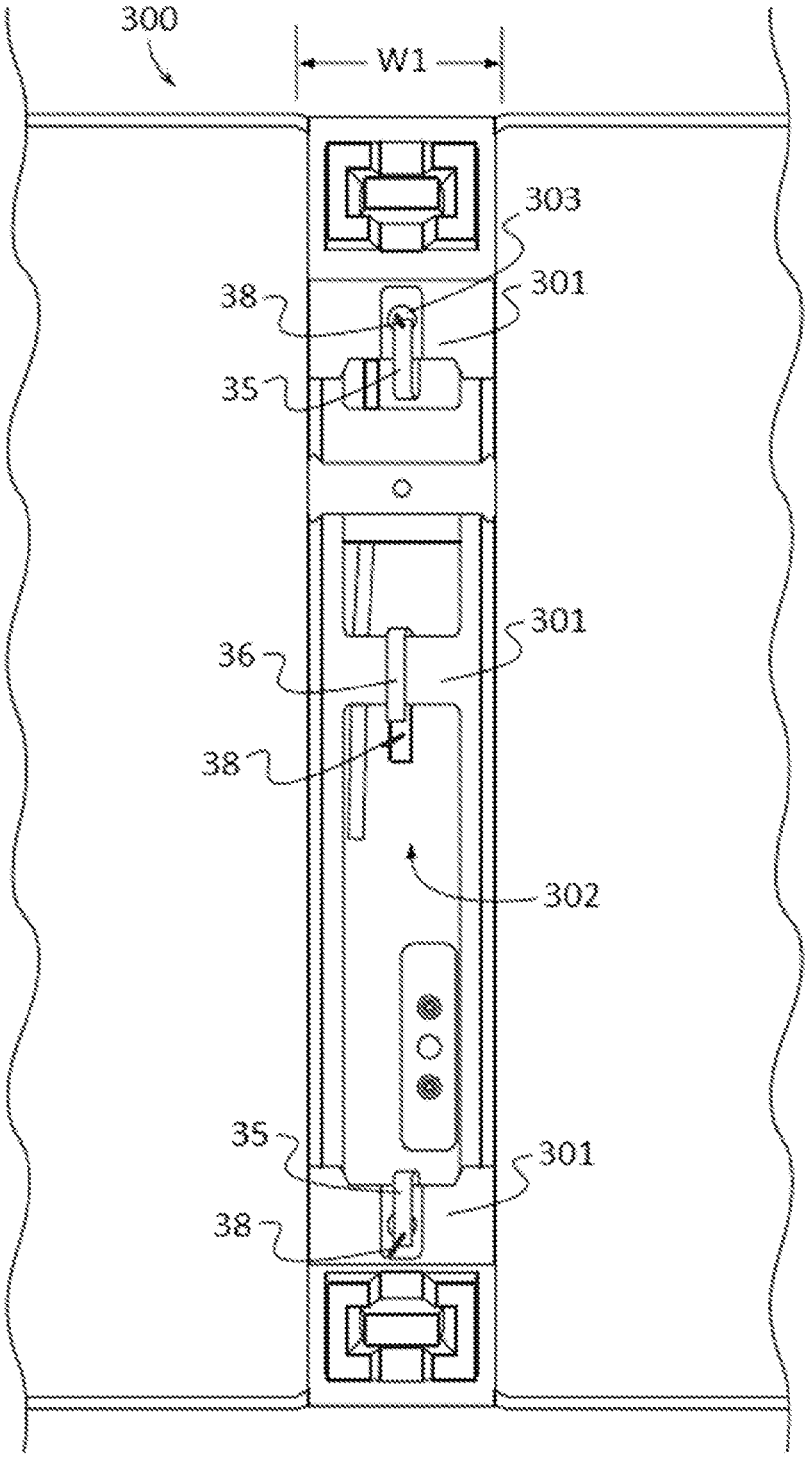
FIG. 7 depicts a front elevation view of an example of a guillotine well of a Modular Causeway Systems section which includes a Connector Assembly Mechanism according to various embodiments described herein.

Referring to FIGS. 5-7, in some embodiments, the device 100 may comprise one or more mounting clips 35, 36, which may be secured to the Connector Assembly Mechanism 301 (FIGS. 7, 12, 15) typically found in a guillotine well 302 (FIGS. 7, 12-15) of a MCS section 300 (FIGS. 7, 8, 12-15). FIG. 5 depicts a mounting clip 35 comprising a generally "U" shape, while FIG. 6 shows an alternative mounting clip 36 comprising a generally "J" shape. In some embodiments, a mounting clip 35, 36, may comprise one or more fastener apertures 37 which may receive and engage with a fastener 38. Optionally, a fastener 38 may comprise a threaded fastener, such as a stud or bolt, or any other type of fastener which may be received and engaged by a mounting clip 35, 36, such as through an optionally threaded fastener aperture 37. In further embodiments, a mounting clip 35, 36, may comprise a seat 45 which may be shaped to rest on a well aperture 303, Connector Assembly Mechanism 301, or other component of a guillotine well 302 as shown in FIG. 7. Preferably, a mounting clip 35 may be positioned to rest in or on a well aperture 303 while an alternative mounting clip 36 may be positioned to rest on a Connector Assembly Mechanism 301. Once positioned, the mounting clips 35, 36, may present a fastener 38 received by the clips 35, 36, to extend out and away from the guillotine well 302 as shown in FIG. 7.

Figure 8:
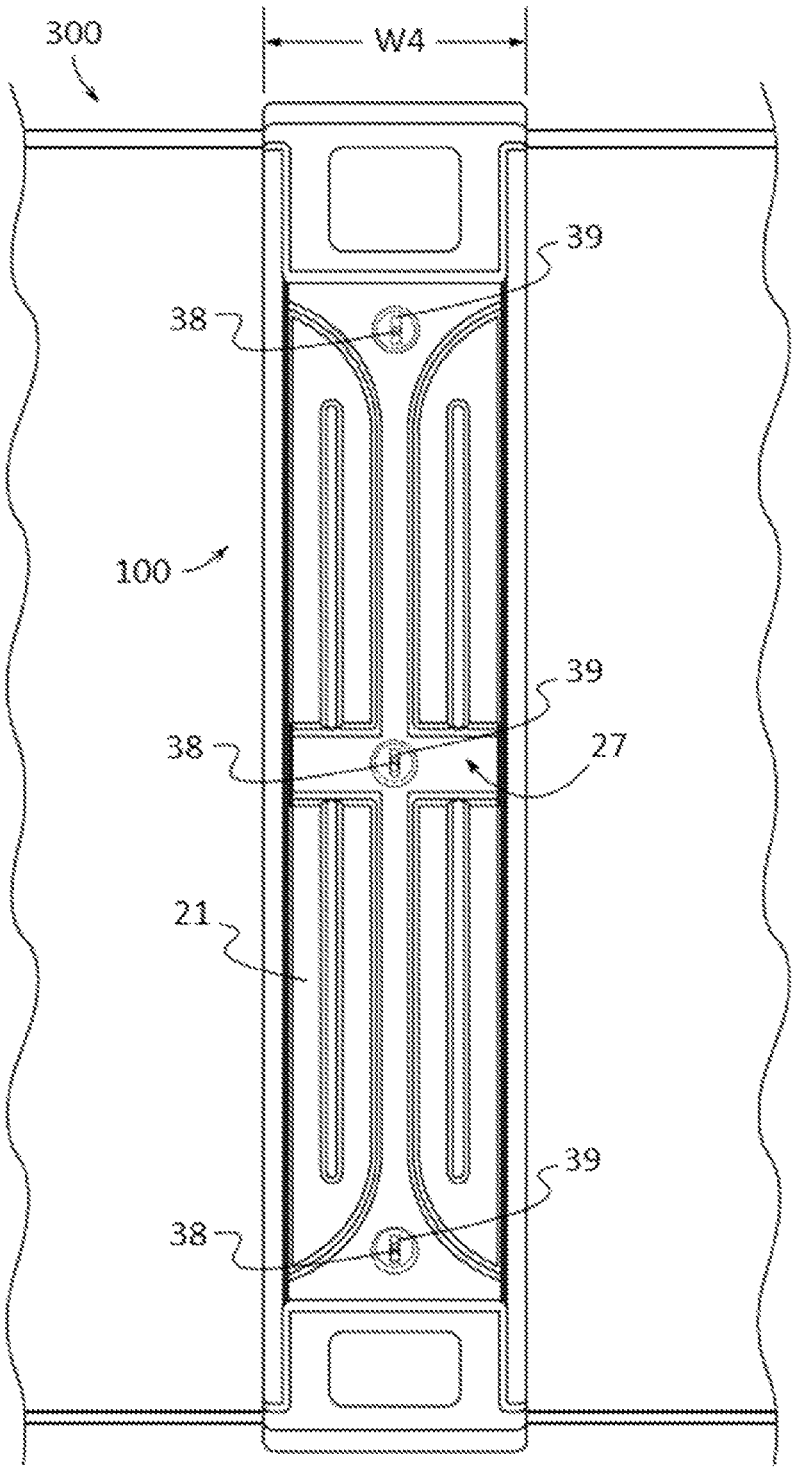
FIG. 8 illustrates a front elevation view of an example of a sealing panel device positioned over a guillotine well of a Modular Causeway Systems section according to various embodiments described herein.
Figure 9:
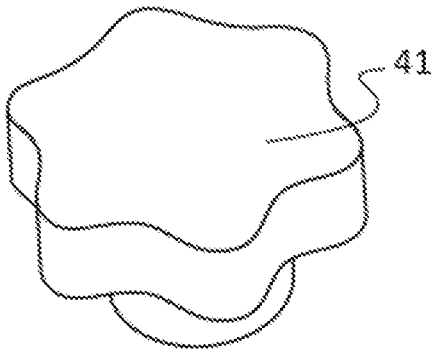
FIG. 9 shows a front perspective view of an example of a fastener retainer according to various embodiments described herein.
Figure 10:
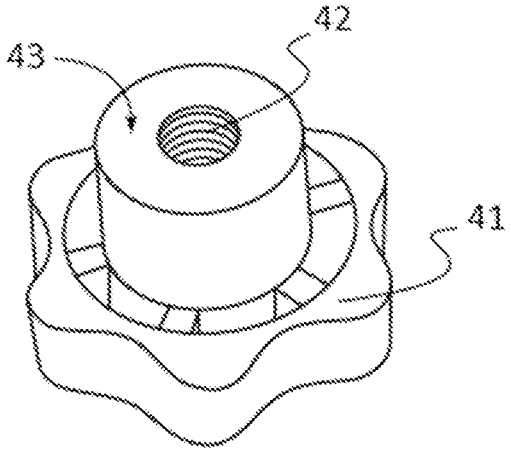
FIG. 10 depicts a back perspective view of an example of a fastener retainer according to various embodiments described herein.
Figure 11:
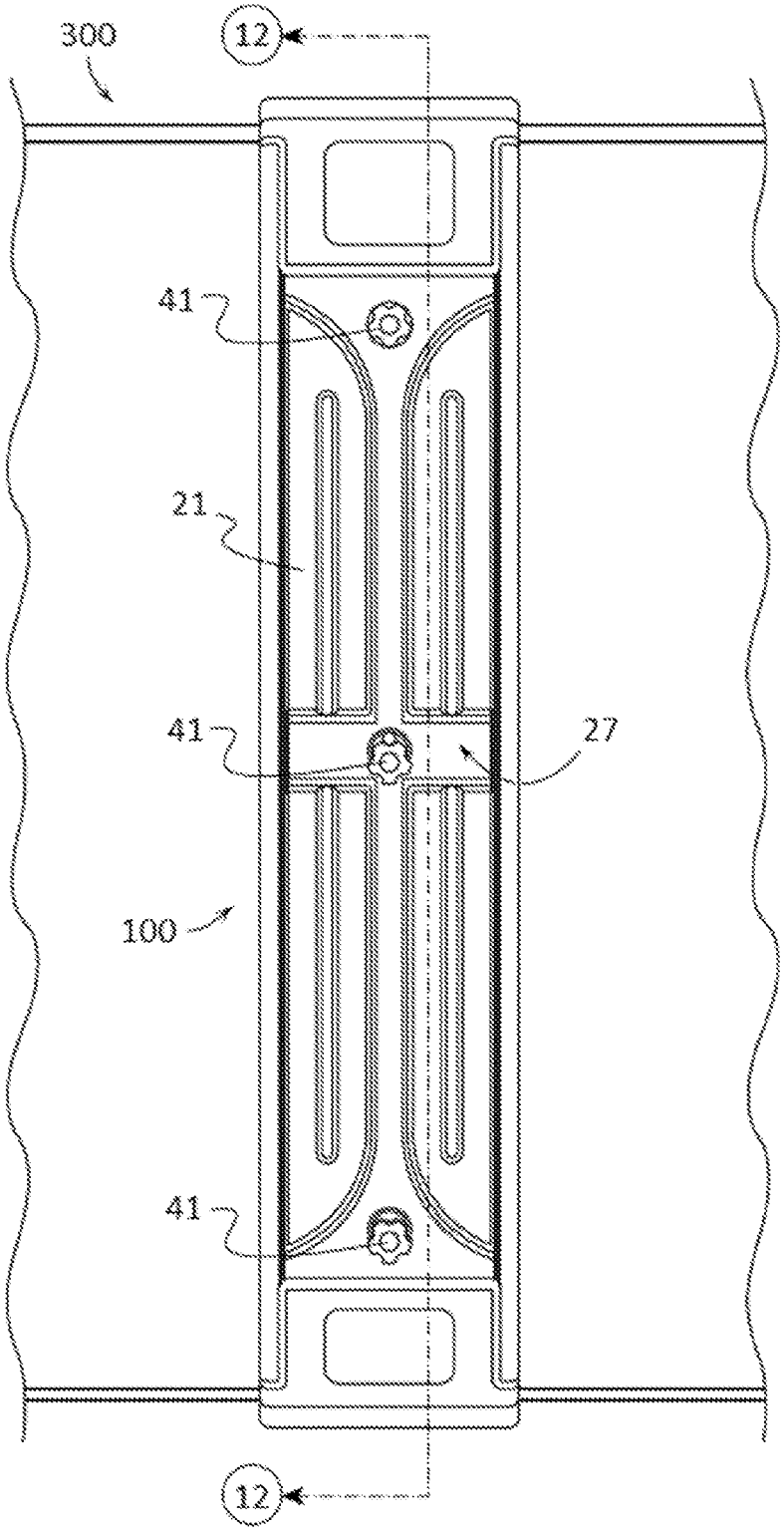
FIG. 11 illustrates a front elevation view of an example of a sealing panel device with fastener retainers secured over a guillotine well of a Modular Causeway Systems section with fastener retainers according to various embodiments described herein.
Figure 12:
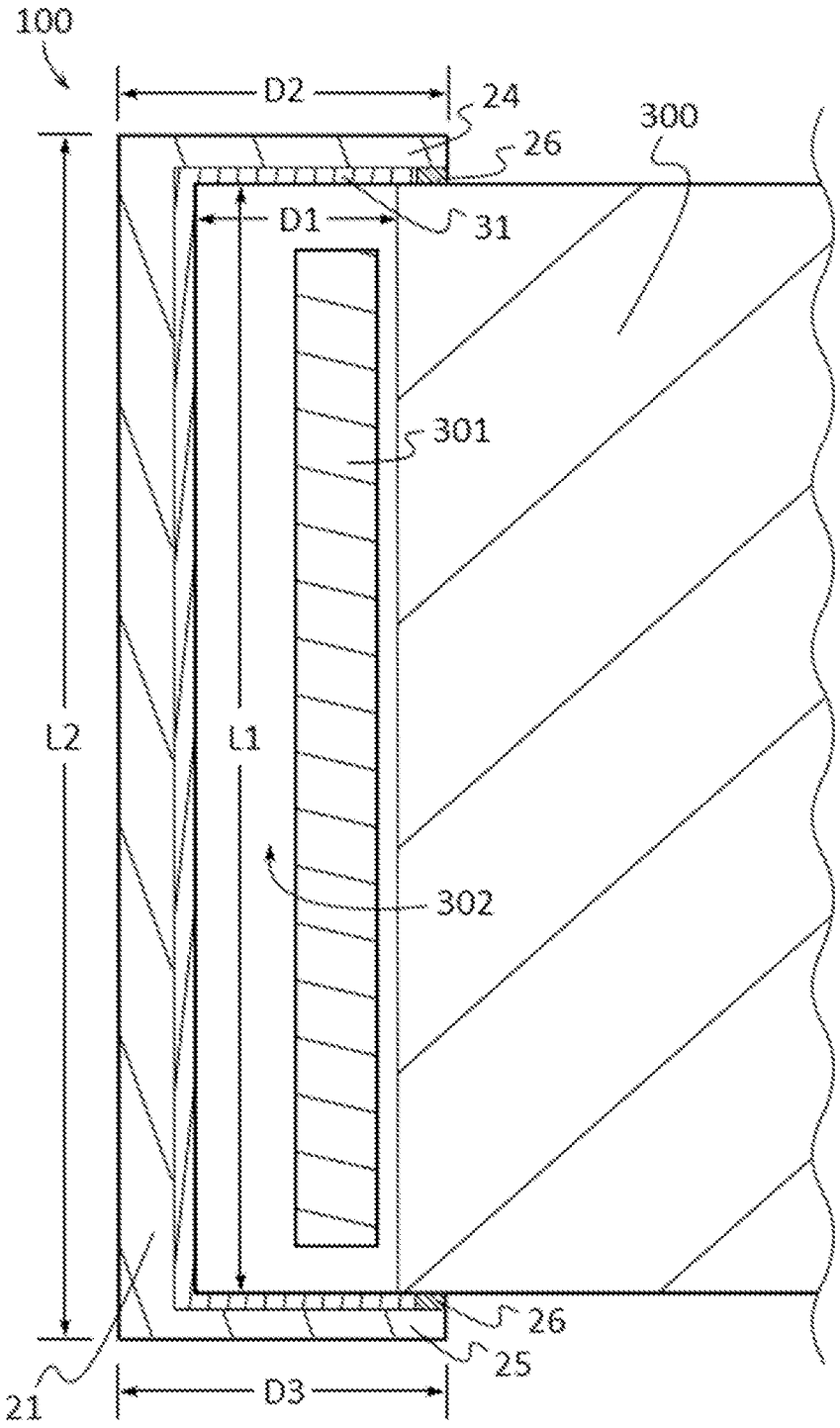
FIG. 12 shows a sectional, through line 12-12 shown in FIG. 11, elevation view of an example of a sealing panel device positioned over a guillotine well of a Modular Causeway Systems section according to various embodiments described herein.
Figure 13:
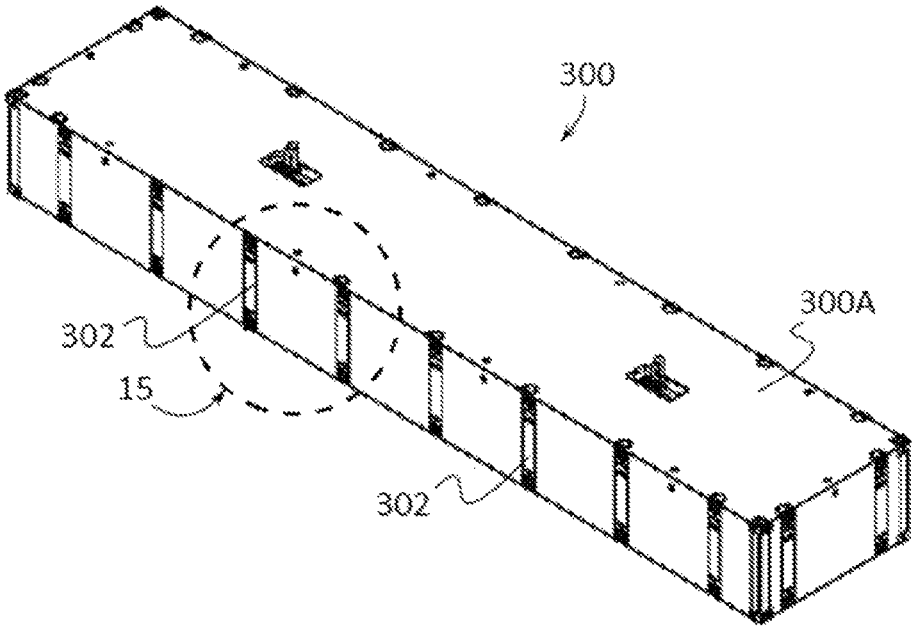
FIG. 13 depicts a top perspective view of an example of a Modular Causeway Systems section of a Modular Causeway System.
Figure 14:
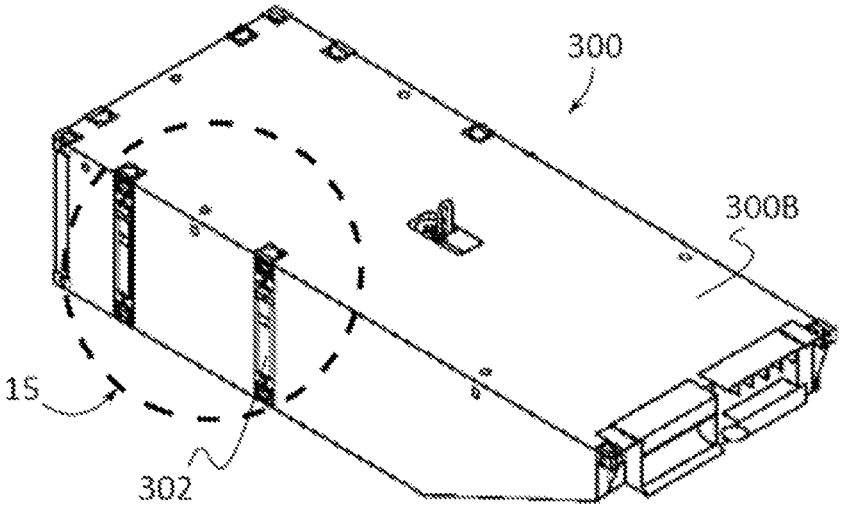
FIG. 14 illustrates a top perspective view of another example of a Modular Causeway Systems section of a Modular Causeway System.
Figure 15:
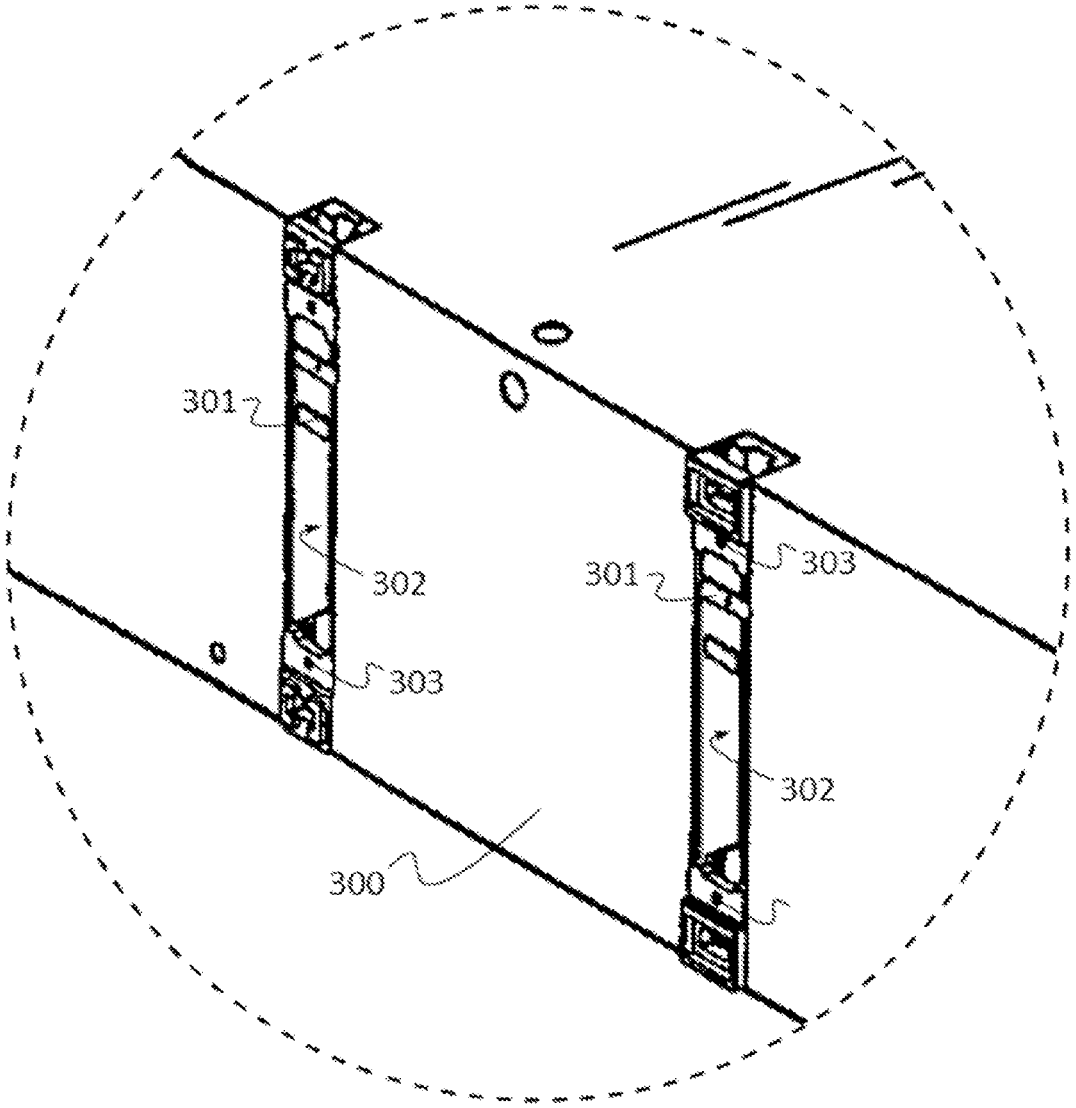
FIG. 15 shows an enlarged view of section 15 as identified in FIG. 13 and FIG. 14 illustrating a top perspective view of two guillotine wells typically found on a Modular Causeway Systems section.

Turning now to FIGS. 8-11, once one or more mounting clips 35, 36, with fasteners 38 have been positioned to rest in or on a well aperture 303 and/or on a Connector Assembly Mechanism 301, as shown in FIG. 7, the device 100 may be positioned over the guillotine well 302 (FIGS. 7, 12-15) of the MCS section 300 (FIGS. 7, 8, 12-15). The fasteners 38 may protrude through the panel apertures 39 of the elongated panel as shown in FIG. 8 and a fastener retainer 41 may be coupled to each of the protruding fasteners 38 as shown in FIG. 11. A fastener retainer 41 may receive the fastener 38 of a mounting clip 35, 36, received in a panel aperture 39 to secure the elongate panel 21 to the Connector Assembly Mechanism 301 (FIGS. 7, 12, 15). In some embodiments, a fastener retainer 41 may comprise a hand turnable knob with female threading 42 which is complementary to the threading on a fastener 38. By turning the fastener retainer 41 in a first direction, the female threading 42 may engage with the threading on the fastener 38 to draw the fastener retainer 41 into contact with the front surface 27 of the elongated panel thereby drawing the sealing gasket 26 and optionally a sealing insert 31 into contact with the MCS section 300 (FIGS. 7, 8, 12-15) over the guillotine well 302 (FIGS. 7, 12-15). By turning the fastener retainer 41 in a second direction, the female threading 42 may disengage with the threading on the fastener 38 to separate the fastener retainer 41 from contact with the front surface 27 of the elongated panel thereby allowing the sealing gasket 26 and optionally a sealing insert 31 to be separated from the MCS section 300 (FIGS. 7, 8, 12-15) over the guillotine well 302 (FIGS. 7, 12-15).

In preferred embodiments, the fastener retainer 41 may be configured as a hand turnable knob with a panel contacting surface 43 into which the female threading 42 may be disposed. Preferably, the panel contacting surface 43 may be shaped to be larger than the shape and size of a panel aperture 39 so that when the fastener retainer 41 is engaged to a fastener 38 protruding through the panel aperture 39 and the panel contacting surface 43 is contacting the front surface 27, the panel contacting surface 43 may completely cover the panel aperture 39 to seal out precipitation, pests, and other contaminants from entering the panel aperture 39. In alternative embodiments, a fastener 38, mounting clips 35, 36, and fastener retainer 41 may be configured as any other set of fasteners or brackets which may be suitable for removably coupling the device 100 to portions of the MCS section 300 (FIGS. 7, 8, 12-15) over the guillotine well 302 (FIGS. 7, 12-15).

While some materials have been provided, in other embodiments, the elements that comprise the device 100, such as the elongate panel 21, arms 24, 25, sealing gasket 31, optional sealing insert 31, optional magnets 32, optional mounting clips 35, 36, optional fasteners 38, and/or optional fastener retainers 41, may be made from durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or comprise durable and slightly flexible materials such as soft plastics, silicone, soft rubbers, or any other suitable materials including combinations of materials. In some embodiments, one or more of the elements that comprise the device 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A sealing panel device for use with Modular Causeway Systems sections which includes a Connector Assembly Mechanism within a guillotine well with the guillotine well having a length, width, and depth, the device comprising:

an elongate panel having a top portion and a bottom portion and having a length and width that is greater than the length and width of the guillotine well;

a first arm coupled to the top portion of the elongate panel, wherein the first arm comprises a width greater than the width of the guillotine well, and wherein the first arm comprises a depth greater than the depth of the guillotine well;

a second arm coupled to the bottom portion of the elongate panel, wherein the second arm comprises a width greater than the width of the guillotine well, and wherein the first arm comprises a depth greater than the depth of the guillotine well; and a sealing gasket coupled to the elongate panel, first arm, and second arm, wherein the sealing gasket contacts the Modular Causeway Systems section around the guillotine well when the elongate panel device is positioned over the guillotine well of the Modular Causeway Systems section.

2. The device of claim 1, further comprising a magnet coupled to the first arm.

3. The device of claim 1, further comprising a magnet coupled to the second arm.

4. The device of claim 1, further comprising a sealing insert coupled to the elongate panel, wherein the sealing insert contacts the Modular Causeway Systems section proximate to the guillotine well when the device is positioned over the guillotine well of the Modular Causeway Systems section.

5. The device of claim 1, further comprising a sealing insert coupled to the first arm wherein the sealing insert contacts the Modular Causeway Systems section proximate to a top of the guillotine well when the device is positioned over the guillotine well of the Modular Causeway Systems section.

6. The device of claim 1, further comprising a sealing insert coupled to the second arm, wherein the sealing insert contacts the Modular Causeway Systems section proximate to a bottom of the guillotine well when the device is positioned over the guillotine well of the Modular Causeway Systems section.

7. The device of claim 1, further comprising a vent aperture in the second arm.

8. The device of claim 7, wherein the vent aperture is within a vent depression.

9. The device of claim 1, further comprising a mounting clip which includes a fastener, wherein the mounting clip secures to the Connector Assembly Mechanism.

10. The device of claim 8, wherein the elongate panel comprises a panel aperture configured to receive the fastener of the mounting clip.

11. The device of claim 9, further comprising a fastener retainer configured to receive the fastener of the mounting clip received in the panel aperture to secure the elongate panel to the Connector Assembly Mechanism.

12. The device of claim 1, further comprising a sealing insert coupled to the elongate panel, wherein the sealing insert contacts the Modular Causeway Systems section proximate to the guillotine well when the device is positioned over the guillotine well of the Modular Causeway Systems section.

13. The device of claim 1, further comprising a sealing insert coupled to the first arm wherein the sealing insert contacts the Modular Causeway Systems section proximate to the top of the guillotine well when the device is positioned over the guillotine well of the Modular Causeway Systems section.

14. The device of claim 1, further comprising a sealing insert coupled to the second arm wherein the sealing insert contacts the Modular Causeway Systems section proximate to the bottom of the guillotine well when the device is positioned over the guillotine well of the Modular Causeway Systems section.

15. The device of claim 1, further comprising a vent aperture in the second arm.

16. The device of claim 7, wherein the vent aperture is within a vent depression.

17. The device of claim 1, further comprising a mounting clip which includes a fastener, wherein the mounting clip secures to the Connector Assembly Mechanism.

18. The device of claim 8, wherein the elongate panel comprises a panel aperture configured to receive the fastener of the mounting clip.

19. The device of claim 9, further comprising a fastener retainer configured to receive the fastener of the mounting clip received in the panel aperture to secure the elongate panel to the Connector Assembly Mechanism.

20. A sealing panel device for use with an Modular Causeway Systems section which includes a Connector Assembly Mechanism within a guillotine well having a length, width, and depth, the device comprising:

an elongate panel with a length and width that is greater than the length and width of the guillotine well;

a first arm coupled to a top portion of the elongate panel, wherein the first arm comprises a width greater than the width of the guillotine well, and wherein the first arm comprises a length greater than the depth of the guillotine well;

a second arm coupled to a bottom portion of the elongate panel, wherein the second arm comprises a width greater than the width of the guillotine well, and wherein the first arm comprises a length greater than the depth of the guillotine well;

a sealing gasket assembly coupled to the elongate panel, first arm, and second arm, wherein the sealing gasket contacts the Modular Causeway Systems section around the guillotine well when the device is positioned over the guillotine well of the Modular Causeway Systems section ; and a magnet positioned to engage with the Modular Causeway Systems section when the device is positioned over the guillotine well of the Modular Causeway Systems section.

* * * * *